United States Patent [19]

Bird et al.

[11] 3,982,483

[45] Sept. 28, 1976

[54] MOISTURE REDUCTION PRESS

[75] Inventors: Thomas C. Bird, Scottsdale, Ariz.; Walter J. Paetzold, Hereford, Tex.

[73] Assignee: Corral Industries, Inc., Phoenix, Ariz.

[22] Filed: Apr. 25, 1975

[21] Appl. No.: 571,569

[52] U.S. Cl. ..... 100/117; 100/148

[51] Int. Cl.[2] ..... B30B 9/18

[58] Field of Search ..... 100/145–150, 100/117

[56] References Cited

UNITED STATES PATENTS

| | | | |
|---|---|---|---|
| 785,876 | 3/1905 | Gropp | 100/150 |
| 1,152,857 | 9/1915 | Stehlin | 100/148 |
| 1,733,381 | 10/1929 | Meakin | 100/147 |
| 1,835,789 | 12/1931 | Lang | 100/117 |
| 2,340,009 | 1/1944 | Meakin | 100/147 X |
| 2,560,147 | 7/1951 | Anderson | 100/147 X |
| 3,592,128 | 7/1971 | French | 100/150 |

*Primary Examiner*—Peter Feldman

*Attorney, Agent, or Firm*—Warren F. B. Lindsley

[57] ABSTRACT

A power operated machine or press which utilizes the principle of the "Archimedian-Screw," in association with screening means and other pressure exerting means to partially separate the solid and liquid elements of compressible animal or vegetable tissue and to control the moisture content of the resultant product.

3 Claims, 9 Drawing Figures

FIG-6
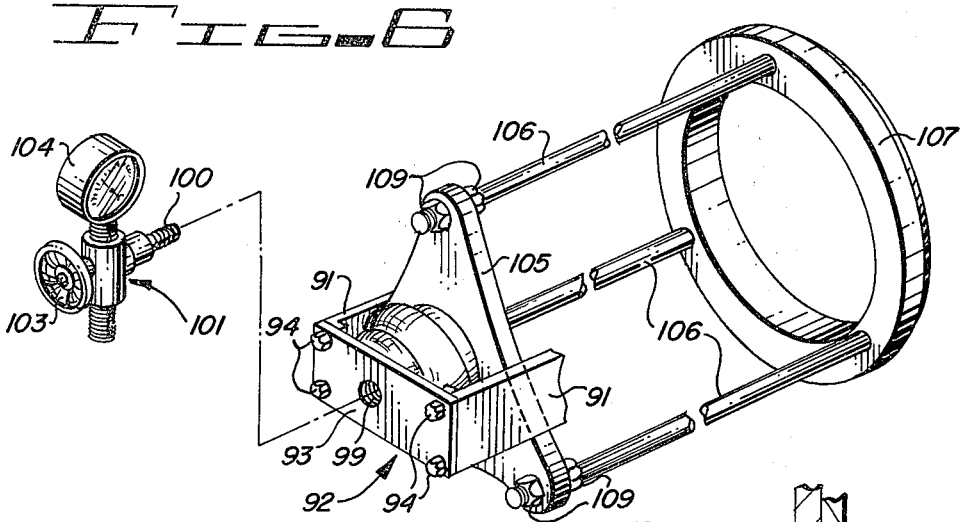
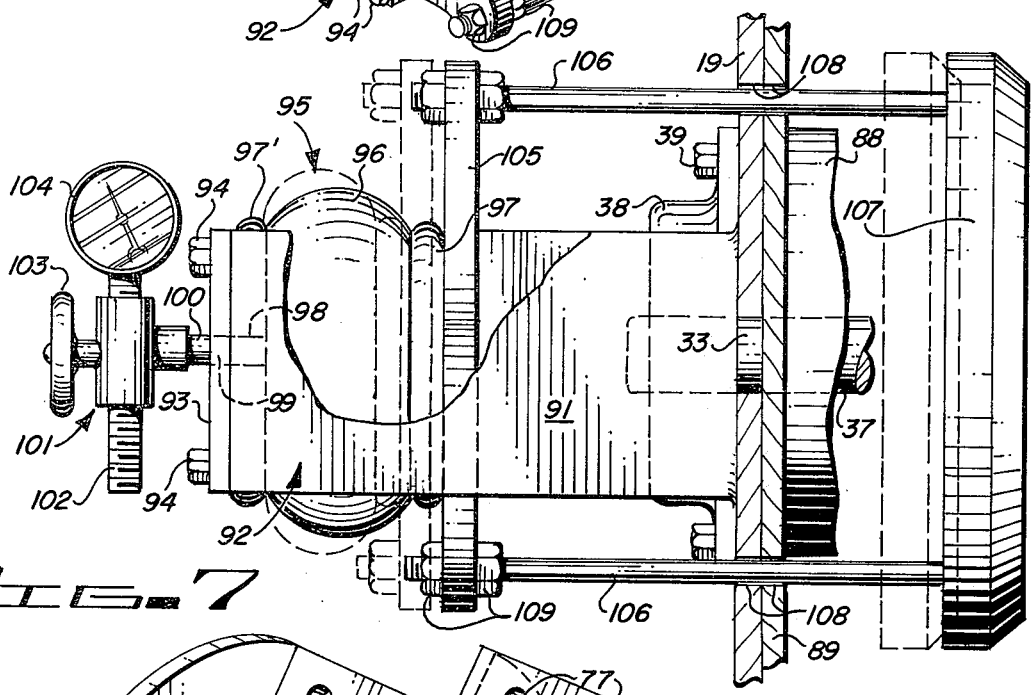
FIG-7
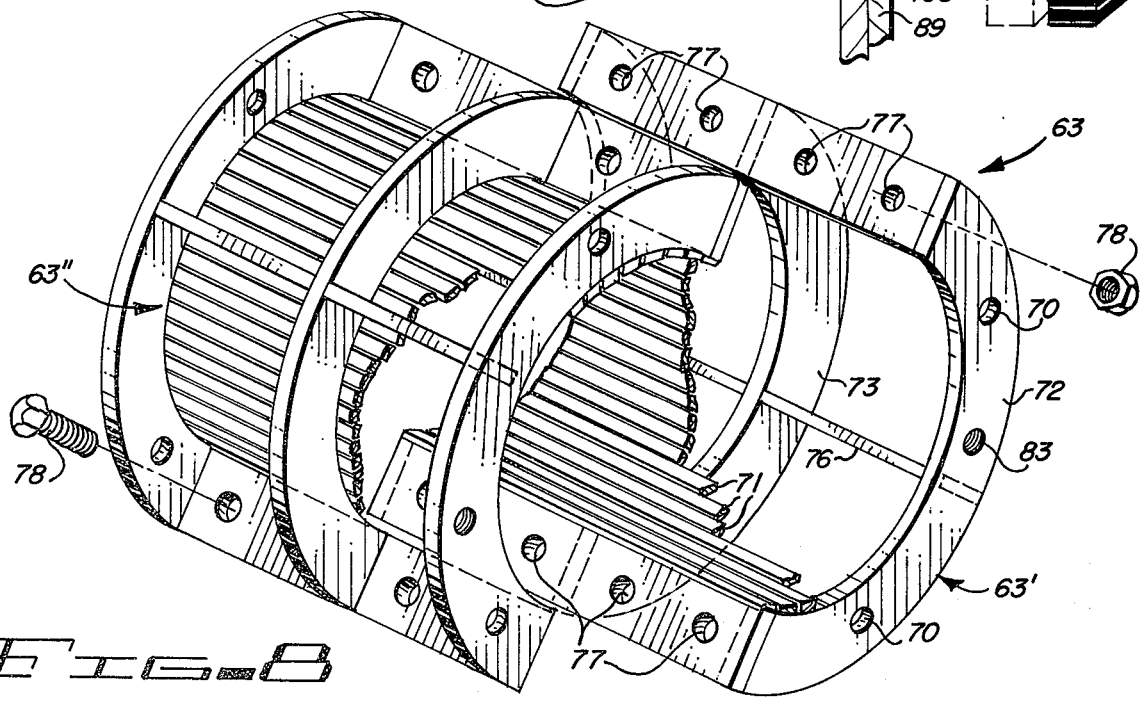
FIG-8

MOISTURE REDUCTION PRESS

BACKGROUND OF THE INVENTION

One of the problems encountered in the process of converting animal waste into a nutritious and palatable feed supplement for refeeding to livestock, is the press which is used for partially separating the solid and liquid elements of compressible animal and plant tissue, including vegetable, fruit and the like, to control the moisture content of the solid portion thereof. Prior art presses require the time consuming necessity of disassembling the entire press for repair or replacement of worn parts at frequent intervals caused by the fibrous and abrasive characteristics of the animal tissue, waste or other matter being processed.

DESCRIPTION OF THE PRIOR ART

Many types of machines or presses have been developed and are available for use in separating and extracting the liquid contents or juices from various kinds of animal or vegetable tissue, such as meat, fish, fruit, nuts and many types of vegetables. These machines or presses are usually quite complicated, expensive to purchase and maintain in good working order for substantial periods of production time, and therefore their use is not feasible, expeditious or efficient enough to perform the specific function of processing such highly abrasive and fibrous matter, as animal waste.

FIELD OF THE INVENTION

Although the machine or press of the present invention has been designed and constructed for the specific purpose of processing and controlling the moisture content of highly abrasive, fibrous material, such as animal, vegetable, fruit and other types of waste, and to withstand the abrasive use to which it will be applied for long periods of time, it should be understood that it can be utilized with efficient and satisfactory results in the processing of other material or matter having abrasive and fibrous characteristics.

SUMMARY OF THE INVENTION

It is, therefore, one object of this invention to provide an improved machine or press capable of processing highly abrasive and fibrous materials with only a minimum of short, infrequent, non-productive down times for the replacement of worn or damaged parts or other servicing requirements.

Another object of this invention is provide an improved press usable for separating the solid and liquid elements of compressible materials to limit or control the amount of moisture retained in its solid end product.

A further object of this invention is to provide an improved power driven press which utilizes the pitch of the convolutions or flights of a rotatable screw confined in a cylindrical screen to gradually increase the pressure exerted on the mass of matter being forced therethrough to squeeze out most of the liquid content of the matter and to direct the extruded matter against variable pressure valve ring to further control or limit the amount of moisture contained in the solid end product dispersed from the press.

A still further object of this invention is to provide a press for separating and partially reducing the liquiid content of animal or vegetable matter passing therethrough which employs a conical shafted conveyor screw or worm, the downstream end convolution or flight of which is provided with quickly removable wear shoes readily made accessible for replacement by the press design.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which:

FIG. 6 is a perspective view of the airstroke actuator and push plate assembly shown removed from the maching or press.

FIG. 7 is a side elevational view of the air-stroke actuator and push plate assembly shown in FIG. 6 installed through the rear vertical wall of the frame of the press and the central driven shaft of the cone and flight assembly with the components of the unit shown in their partially pressurized relationship in solid line and in their relationship in dotted lines.

FIG. 8 is a perspective view of the large diameter, cylindrical, two piece exterior screen structure utilized in the press, showing the pieces of the screen structure in exploded relationship to each other.

DESCRIPTION OF THE PREFERRED EMBODIMENT

Figure 1:
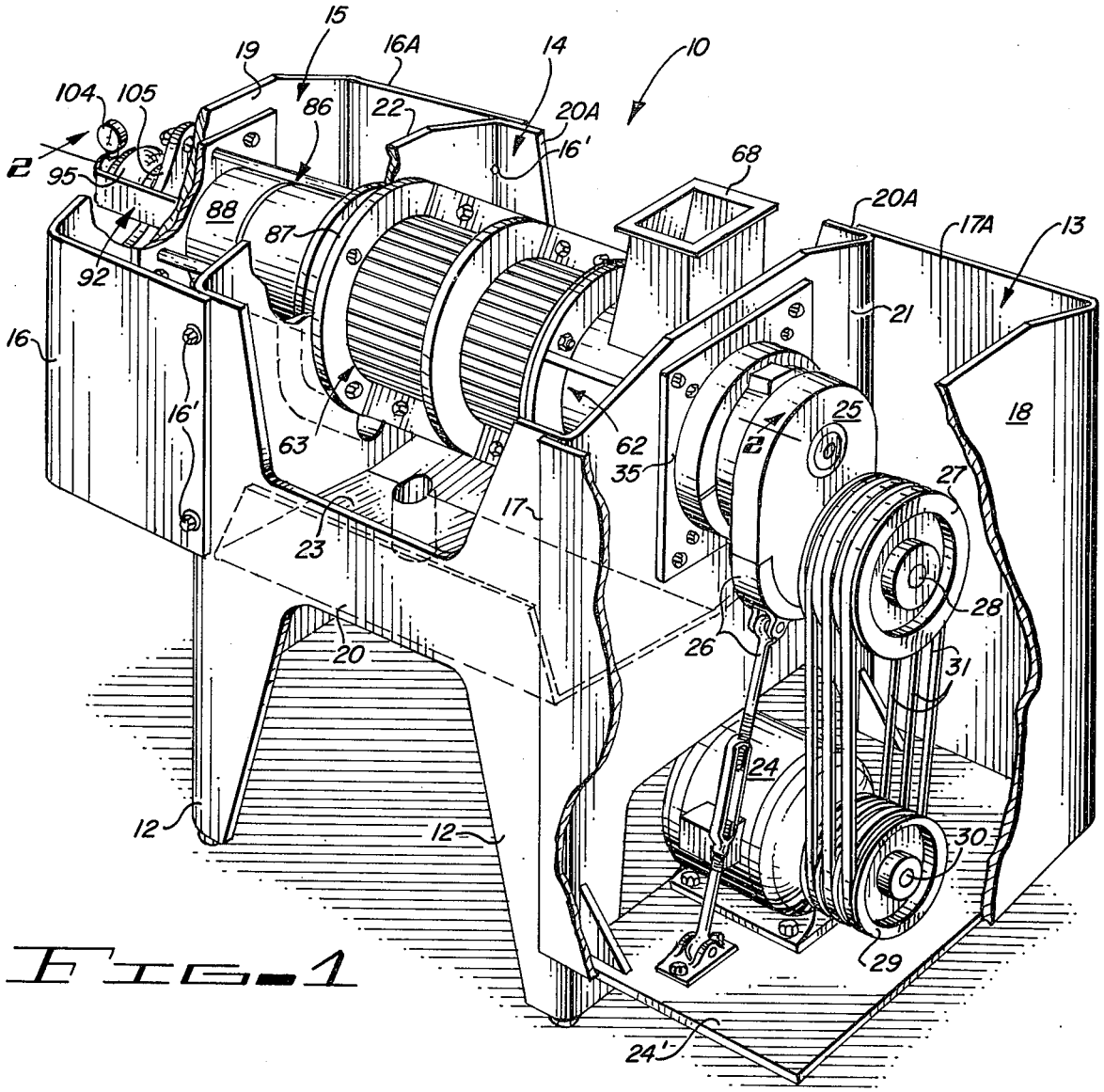
FIG. 1 is a perspective view of a machine or press with some parts broken-away and in section to more clearly illustrate the features of the invention.
Figure 2:
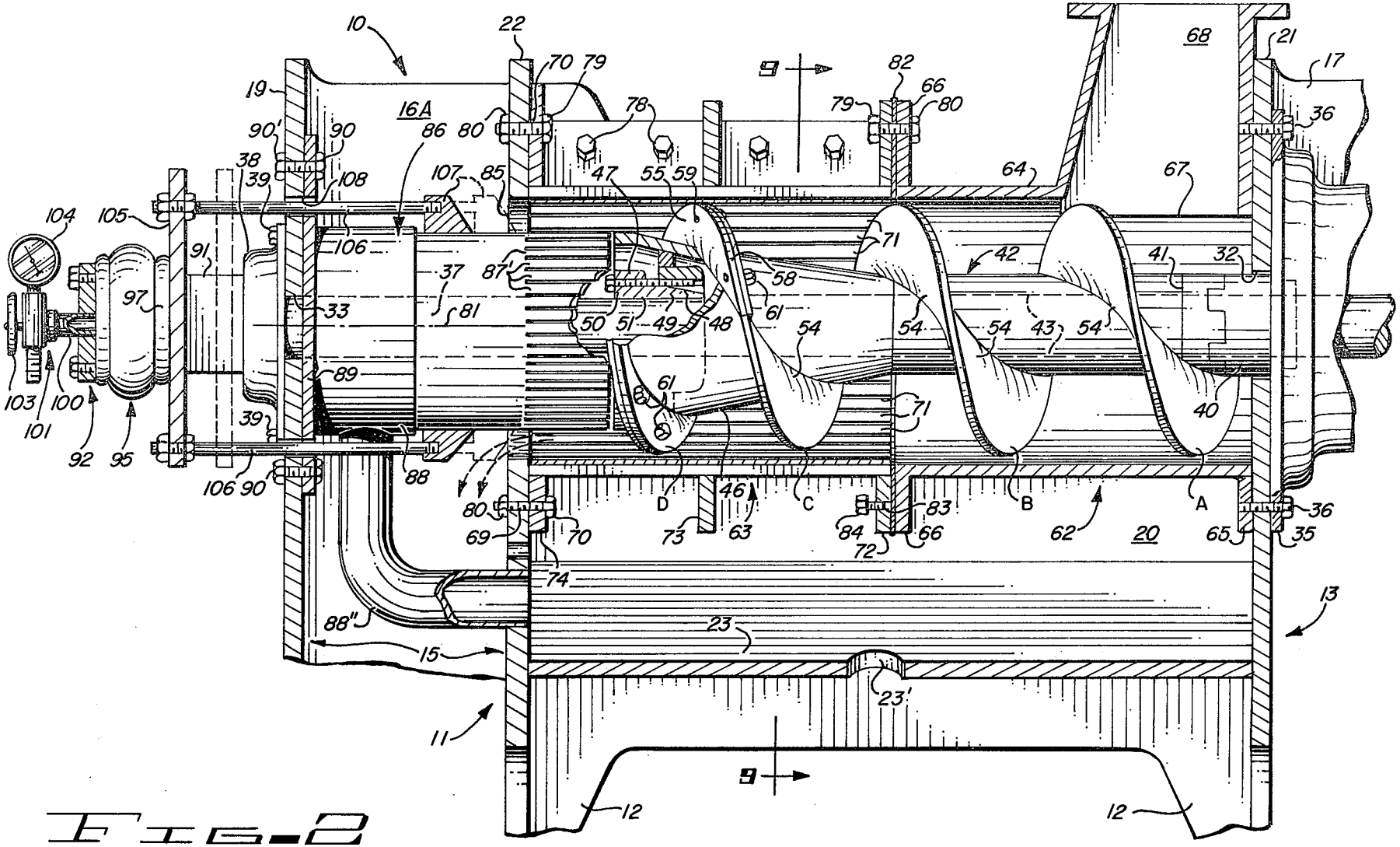
FIG. 2 is a longitudinal, vertical sectional view of the machine or press shown in FIG. 1 taken substantially along the line 2—2.
Figure 3:
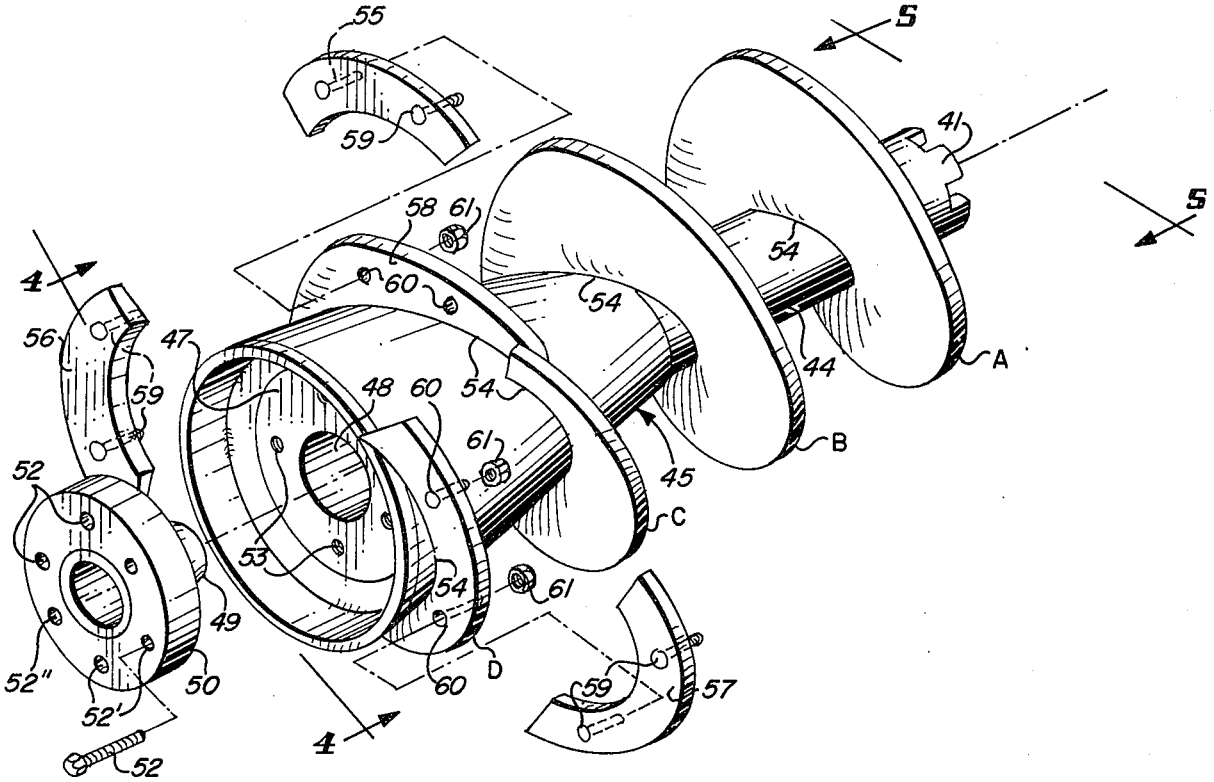
FIG. 3 is a perspective exploded view of the flight assembly or conveyor screw of the press shown in FIGS. 1 and 2.
Figure 4:
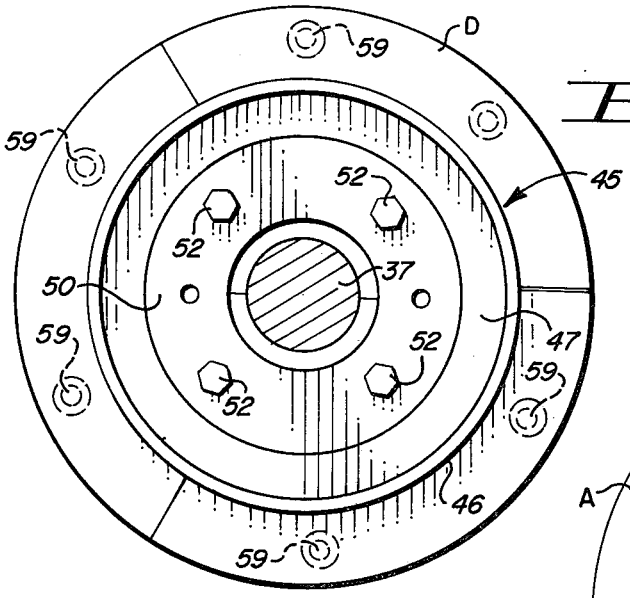
FIG. 4 is an elevational view of the large open end of the cone and flight assembly showing the respective relationship of its component parts in their assembled position when mounted on the central drive shaft of the press.
Figure 5:
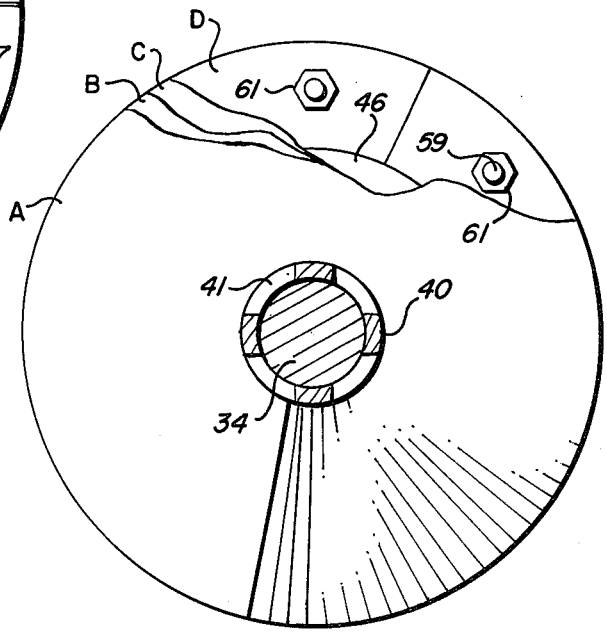
FIG. 5 is an elevational view of the small closed end of the cone and flight assembly with a portion of the spiral flights broken away to show one method of securing the three wear shoes to the front indented face of the last flight.

Referring more particularly to the drawings by characters of reference, FIGS. 1 and 2 disclose a machine or press 10 comprising a frame 11 supported by two pairs of vertically positioned legs 12. The frame is divided into three partially open compartments 13, 14 and 15 by a vertically extending pair of side walls 16, 16A and 17, 17A, front and rear walls 18 and 19, and cut-away or open sided walls 20, 20A which are formed integrally with the transverse vertically extending partition walls 21 and 22 and welded to a sloping drain pan 23 of the central compartment 14.

Compartment 15 formed by side walls 16, 16A and integral transverse rear wall 19 is secured in removable relationship to the side walls 20, 20A of the central compartment 14 by means of studs or bolts 16' and when so assembled is open at its top and bottom ends to provide access to the press components that are housed therein and space for processed material to fall through. Compartment 13 houses an electric drive motor 24 securely mounted on a rigid platform 24', a speed reducer 25 together with its torque arm adapter 26, and a driven sheave 27 mounted on a drive shaft 28 extending from speed reducer 25. Drive sheave 29 mounted on shaft 30 of motor 24 drives sheave 27 by means of V-belts 31.

The vertical transverse partition wall 21 and the rear wall 19 are provided with suitably sized clearance holes 32 and 33, respectively, which are vertically, horizontally and longitudinally aligned for passage therethrough of the projecting end portion of a stub drive shaft 34 and central driven shaft 37. Shaft 34 is journaled in a bearing (not shown) in the housing of speed reducer 25 which is secured by a flange 35 and studs 36 to the front face of partition wall 21, as shown in FIG. 2. The clearance hole 33 in the rear transverse wall 19 allows passage of the rear end of the stub driven shaft 37 therethrough. Driven shaft 37 is journaled in a suitable bearing support member 38 which is secured to the rear face of wall 19 by studs 39.

The driving connection between the short, stub drive shaft 34 and the long, central driven shaft 37 preferably consists of mating cluch elements 40 and 41, which are of larger diameter than their respective shafts to which they are integrally or otherwise secured in driving but separable relationship to each other. Before the driven shaft 37 is installed in the press with the clutch element 41 in driving contact with the clutch element 40, and before the side walls 16 of the removable rear compartment 15 are rigidly attached by the studs or bolts 16' to the side walls 20 of the central compartment 14, the cone and flight assembly 42 of the press is installed on the central driven shaft 37. The central bore 43 of the straight diameter portion 44 of a cone member 45 is placed around driven shaft 37 in sliding relationship thereto with its end face abutting the face of the rim formed by the outside diameter of the clutch element 41 previously installed at the end of driven shaft 37 (as best seen in FIG. 2).

In order to removably but rigidly secure the conical rear end portion 46 and its integral, straight length diameter portion 44 of the cone and flight assembly 42 in its respective longitudinal relationship on the driven shaft 37, the hollow interior of the conical rear end portion 46 of the cone is fitted with a female portion of a tapered ring bushing 47. The outer circumference of the ring bushing is secured to the interior circular wall of the conical rear end portion 46, as by welding, to thus become an integral part of the cone member 45. In the exact center of the cone is provided a tapered bore 48 into which a mating, male tapered extension 49 of a similar diameter removable male bushing member 50 is adapted to fit in wedging relationship thereto. Bushing member 50 with its central bore 51 is moved into the tapered bore 48 of the permanently mounted female ring bushing 47 and held therein by several hex-head studs 52 which are adapted to pass through clearance holes 52' in the bushing member 50 and engage in female threaded holes 53 provided in the face of the permanently mounted ring bushing 47 to thus position and securely lock the cone and flight assembly 42 on the driven shaft 37 in readiness for installation in frame 11 of press 10. It should be noted that a pair of auxiliary female tapped holes 52'' are provided in the face of the locking male bushing member 50 which may be utilized with suitable hex-head studs (not shown) to break the tight frictional contact of the bore 51 with the driven shaft 37 when it is desired to separate or disassemble these components.

The cone and flight assembly 42 consists of the cone member 45 having the straight length diameter portion 44 and the integral conical rear end portion 46. The conical rear end portion 46 is provided with at least four spiral convolutions or flights A, B, C and D, respectively, shown in FIG. 2, 3, 4 and 5 which are rigidly secured at their spiraling base surfaces 54 tothe outside circumferential surfaces of the straight and conical portions of the cone member 44 and 45. The outside diameters of the flights, being equal, result in a gradually decreasing depth of each flight from B to D, the purpose of which will hereinafter appear, together with the need for three or more hardened steel wear shoes 55, 56 and 57, which are flat-sided and arcuately shaped to conform to the flat, depressed circumferential surface 58 of the rear-most flight D.

Each of the wear shoes is of equal arcuate length having radial disposed ends that are adapted to abut the radial end of the depressed surface 58 of the flight and the opposed radial end of each other. These shoes lie flat against the depressed surface 58 and are adapted to be securely but removably attached to this surface by a plurality of threaded studs 59, at least two of which are welded at one end into suitably radially spaced apertures formed in each shoe. The studs extend in perpendicular relationship a sufficient distance to pass through similarly spaced clearance holes 60 formed in the depressed surface portion 58 of flight D. When drawn up tightly by a similar number of nuts 61, they complete the cone and flight assembly 42 before it, together with the central driven shaft 37, is installed in frame 11.

Previous to the installation of the cone and flight assembly with the central driven shaft 37 in the support frame 11, other components of the press 10 must be installed. These components include the infeed tube assembly 62 and the lower half of the exterior screen assembly 63. The infeed tube assembly comprises a cylindrical housing 64 having flat faced radially extending, circular flanges 65 and 66, respectively, at its opposite ends. The cylindrical wall of housing 64 is cut out at its top center to form an arcuate opening 67 over which a similarly shaped bottom end of a vertically mounted infeed hopper 68 rests and is securely welded thereto. The circular flange 65 and the transverse partition wall 21 of the shell compartment 13 are provided with aligned holes for the reception of hex-head bolts 36 that extend through clearance holes in the infeed bearing mounting plate 35 into said aligned holes to support the infeed tube assembly 62, diametrically about the axis or center of the clearance hole 32 on the transverse partition wall 21 of the shell. The infeed tube assembly 62 extends about halfway into the shell compartment 14, as shown in FIGS. 1 and 2 of the drawings.

The circular radial flange 66 at the inner end of the infeed tube assembly 62 and the transverse partition wall 22 are each provided with at least four circumferentially and radially spaced clearance holes 66' and 69, respectively.

Figure 9:
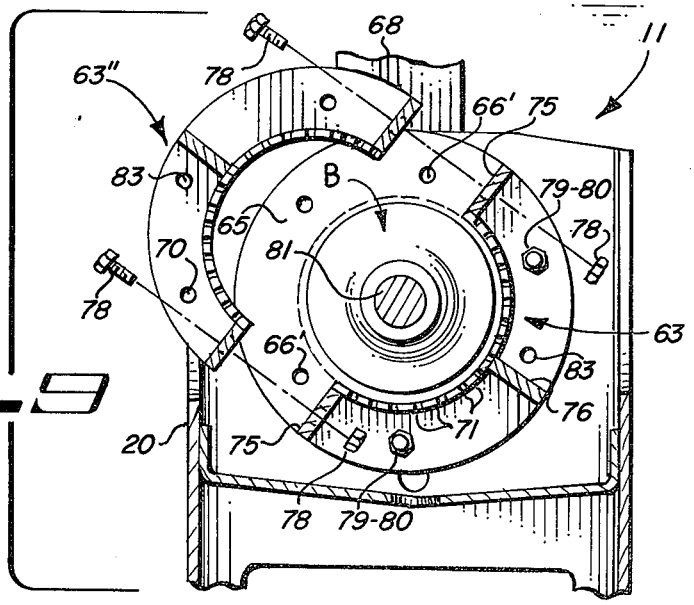
FIG. 9 is a transverse vertical sectional view taken substantially on the line 9—9 of FIG. 2 showing the lower portion of the exterior screen structure secured to a vertical wall of the frame in its assembled relationship relative to the cone and flight assembly and with the top portion of the same shown in exploded relationship thereto.

The exterior screen assembly 63 is fabricated in two identical, semi-circular half sections 63' and 63'' that are bolted together at final assembly of press 10 to form a single drum like exterior screen assembly 63 which is shown in its assembled and installed relationship in FIGS. 1 and 2, and in its separated or disassembled relationship in FIGS. 8 and 9 of the drawings. The detailed construction of only the lower half section 63' of the screen assembly which is installed first in compartment 14 of the shell assembly before the cone and flight assembly 42 will be described since the other half is substantially identical.

The lower half section 63' of the exterior screen assembly 63 is comprised of a semi-circular, drum like screen that is fabricated from a plurality of longitudinally extending stainless steel metal strips 71. Strips 71 are welded at both ends and at their centers to the inside semi-circular edges of the radially extending, semi-circular, flat surfaced flanges 72, 73 and 74, as shown. The longitudinal strips 71 are spaced apart and arranged in parallel relationship to each other so as to form a plurality of very narrow longitudinal slits to thus form the lower semi-circular half portion 63' of the exterior screen assembly 63. The ends of the semi-circular radial end flange 72 and 74 and the center of the radial flange 73 are joined by welding to a pair of radially extending longitudinal connecting bars or staves 75 shown more clearly in FIG. 9 and a radially extending longitudinal reinforcing bar or stave 76. Stave 75 serves to stiffen the lower half section 63' of the screen assembly and provide the necessary flat, aligned mating surfaces with spaced clearance holes 77 for connecting the upper, semi-circular half section 63'' to the lower, semi-circular half section 63' by means of the bolts and nuts 78 to complete the assembly of the exterior screen 63.

At least two clearance holes 70 are provided in the semi-circular radial end flange 72 that are located so as to align with the previously formed clearance holes 66' in the circular assembly 62 and the holes 69 in the transverse partition wall 22 of the shell. These holes are adapted to receive the hex-head bolts 79 with their locking nuts 80 to secure the respective semi-circular half sections 63' and 63'' of the exterior screen assembly 63 to the transverse partition wall 22 of the shell in rigid but removable longitudinally and radially aligned relationship with the axis 81 of the driven shaft 37, the stub driving shaft 34 and the cone and flight assembly 42.

It should be noted that during the installation of either the lower semi-circular half section 63' or the complete exterior screen assembly 63 in the compartment 14 of the shell, as above described, a circular shim 82 of the desired thickness having properly spaced clearance holes for the reception of the bolts 79 is interposed between the mating surfaces of the radial flanges 66 and 72, respectively, before the bolts are drawn up tightly by the nuts 80. This shim is utilized to prevent any possible distortion of the screen assembly or the other components of the press to which it is attached and supported in closely coupled relationship and to provide a means for breaking this closely coupled bond between said components when either a half semi-circular section or the entire assembled exterior screen 63 is to be removed for servicing purposes.

The preferred means for accomplishing this above stated function includes a pair of tapped holes 83 that are provided in the radial flanges 72 of the screen which are located closely adjacent and on opposite sides of the longitudinally disposed, center connecting bar or stave 76 in each section. These tapped holes 83 are adapted to receive like threaded, hex-head studs 84 that may be turned into the tapped holes 83, after loosening or removal of the attaching bolts and nuts 79 and 80, a sufficient distance to cause the ends of the studs 84 to contact the face of the circular flange 66. By applying sufficient pressure thereon, a breaking of the bond between the abutting radial flanges occurs to allow easy removal of shim 82 and then the half section or the complete assembled exterior screen 63 from its installed position in the compartment 14 of the shell.

It is thought to be an advantageous procedure in the installation of the various components of the press in the center and rear compartments 14 and 15 of the support frame and shell of the machine that the side walls 16 and the rear wall 19 forming compartment 15 be removable and only the lower half section 63' of the exterior screen assembly 63 be installed before the installation of the sub-assembly of the central driven shaft 37, and the cone and flight assembly 42.

A large circular opening 85 which may be slightly larger in diameter than the inside diameter or bore of the assembled exterior screen 63 and slightly greater than the outside diameter of the flights A, B, C and D of the cone and flight assembly 42, is formed in the transverse partition wall 22 and located with its radial center in exact alignment with the central axis 81 of shafts 37, 34 and the cone and flight assembly 42. Thus when shaft 37 and the cone and flight assembly 42 secured thereon is inserted through the circular opening 85 into the interior bores of the exterior screen assembly 63 and the housing 64 of the infeed tube assembly 62, the outside diameter edges of the respective flights will easily clear the circumferential inner edge of opening 85 to allow said components to be inserted far enough to bring the clutch element 40 on the driving shaft 34 in driving relationship therewith thereby allowing the exposed rear end of the shaft 37 to protrude a considerable distance rearwardly therefrom.

Before the integral vertical side walls 16 and the rear transverse wall 19 that form the rear compartment 15 is rigidly and securely attached to the cut-away or open side walls 20 of the central compartment 14 by the studs 16', an interior screen assembly 86 consisting of a forwardly projecting cylindrical tube portion 88, an integral flange member 89 is attached to the inside vertical face of the rear transverse wall 19 by means of the bolts 90 and nuts 90' with bolts 90 projecting through accurately located and aligned clearance holes provided in the flange 89 and the transverse rear wall 19. Thus, the longitudinal center of the interior screen assembly is in true alignment with the center of the clearance hole 33 previously formed in the wall 19 and the axis 81 of the driven shaft 37 when installed.

The cylindrical screen portion 87 is preferably fabricated of a plurality of narrow, metal, longitudinally extending and closely spaced parallel strips 87' forming a plurality of very narrow longitudinal slits around the complete circumference of the cylindrical screen. The strips 87' being welded at their rear ends to the inside diameter of the cylindrical tube portion 88 of the assembly 86 and at their forward ends to a spacer band (not shown) maintain the critical slit-forming spacing of the strips.

The forward ends of legs 91 of a U-shaped bracket assembly 92 are welded securely to the rear face of wall 19 so as to straddle the bearing support member 38 with the rear ends of legs 91 being provided with right angled flanges to which a transverse cover plate 93 is secured by the hex-head studs 94.

An airstroke actuator assembly 95 consisting of a hollow, flexible, longitudinally expandable, doughnut shaped rubber ring 96 is mounted on bracket assembly 92. It is shown in its contracted position in full lines in FIG. 2 and in its expanded position in full line in FIG. 7. Ring 96 is closed on both sides by a pair of similar circular metal discs 97 and 97' which are secured to the flexible rubber ring with the rear disc 97' provided with a pipe tapped hole 98 at its exact center. Hole 98 is adapted to receive through a clearance hole 99 in the center of the transverse cover plate 93 one end of a threaded pipe fitting 100. Pipe fitting 100 is preferably an integral extension of the pressure regulating valve 101 which is provided at its inlet end with a threaded extension 102 having a one-way check valve (not shown) to which a pipe line from a compressor or other air pressure source (also not shown) is adapted to be connected by suitable fittings.

The threaded pipe fitting or extension 102 of valve 101 functions as a supporting and retaining means for the airstroke actuator assembly 95 and as an inlet for pressurized air flowing into the hollow interior of the flexible rubber ring 96. This air under pressure causes the longitudinal expansion of the ring 96 the extent of which is controlled by the pressure regulating valve 101. The desired setting of valve 101 may be adjusted by a control wheel of knob 103 and visually indicated to the operator by a pressure gauge 104 which is threaded on or otherwise secured to the valve 101.

The rear face of a triangular shaped or contoured push plate 105 is secured to the front face of the circular disc 97 of the airstroke actuator assembly 95 in abutting relationship so as to move longitudinally forward or backward when the flexible rubber ring 96 of the actuator is expanded or contracted. The push plate 105 is provided at its three rounded corners with clearance holes through which a like number of threaded push rods 106 are secured into aligned and spaced threaded holes in the rear face of a valve ring 107. Valve ring 107 is chamfered or its forward face and its inside diameter is slightly larger than the outside diameter of the components of the interior screen assembly 86 which it is adapted to surround in moving relationship therewith. Spaced clearance holes 108 are provided in flange member 89 of the cylindrical tube portion 88 of the interior screen assembly and the rear transverse wall 19 of the shell, through which the push rods 106 are adapted to extend into and through the clearance holes in the rounded corners of the push plate 105, where they are secured in adjustable, lengthwise relationship by means of suitable nuts 109.

When all of the operating components of the airstroke actuator assembly 95 have been installed on the rear transverse wall 19 and side walls 16 forming compartment 15 of the support frame assembly 11, this complete sub assembly is rigidly attached to the side walls 20 of the shell by studs or bolts 16'. This action occurs by merely sliding the bearing support member 38 onto the end of the driven shaft 37 to properly position all of its components and especially the interior screen assembly 86 in supported relationship surrounding the projecting end of the shaft 37, as shown in FIG. 2 of the drawings. It should be noted that when said sub-assembly is so installed, the forward end face or edge of the stationary cylindrical inner screen 87 having approximately the same outside diameter as the end face or edge of the rotatable cone member 45 of the flight assembly 42, the clearance between the faces or edges of these respective components will be a minimum distance (only a few thousandths of an inch) in order for said elements to perform their proper function.

OPERATION AND USE

As stated in the paragraph pertaining to the "Field of the Invention," the machine or press shown and described has been especially designed and constructed for the processing and controlling of the moisture content of highly abrasive, fibrous materials such as, for example, animal waste (manure). The following description of the operation of the press will be directed to animal waste only for purposes of description since other waste material can be processed equally well. It should also be understood that this machine or press can be utilized in the processing and/or separation of the liquids and solids of any plastic material including animal or vegetable tissue without any major changes of its operating components.

With the upper half section of the exterior screen 63'' installed to complete the screen assembly 63 surrounding the cone and flight assembly 42, the machine or press is ready for operation by energizing the electric drive motor 24. Motor 24 through its power train including the motor sheave 29, V-belts 31, driven sheave 27 and the speed reducer 25 is adapted to rotate the stub drive shaft 34 in a clockwise direction at a controlled speed under varying torque conditions. Through the positive connection of the clutch elements 40 and 41 on the stub drive shaft 34 and on the central driven shaft 37 to which the cone and flight assembly 42 is secured causes rotation of these latter elements in a similar controlled manner, according to any back pressures that may be imposed on the respective flights A, B, C and D of the cone and flight assembly 42 during its rotation.

With the cone and flight assembly 42 rotating within the cylindrical bores or interiors of the infeed tube assembly 62 and the exterior screen assembly 63, the animal waste (manure) to which a certain amount of water or other liquid may have been added during its processing is introduced into the forward end of the infeed tube or housing 64 through the infeed hopper 68. This mass is then continually moved rearwardly through the infeed tube and the exterior screen by the pressure imposed on the same by the revolving blades or flights of the cone and flight assembly 42.

As this mass is moved rearwardly in the confines of the cylindrical screen, it undergoes steady increasing pressures due to the reduction in the cylindrical areas between the cone portion 45 of the flight assembly and the interior diameter of the exterior screen 63 thereby thoroughly but gradually compressing the mass and squeezing the greater part of the liquid contents therefrom. This liquid drains through the plurality of longitudinal slits formed by stainless steel strips of the screen onto the sloping floor portion 23 of the central shell compartment 14 and through an aperture 23' formed therein into a suitable container (not shown) for its collection and use for various by-products, such as liquid fertilizer or the like.

The remaining semi-solids of the mass which are very fibrous and abrasive are impinged against the surfaces and outer circumferential edges of the wear shoes 55, 56, 57 secured to the depressed surface 58 of the last flight D of the cone and flight assembly 42 which it encounters in its forced rearward movement. These shoes are adapted to withstand the contact of such highly abrasive matter for long periods of time without undue wear nnd necessary replacement. The semi-solids then move through the large circular opening 85 in the transverse portion wall 22 of the shell where it is put into controlled, pressure exerting contact with the front face of the valve ring 107. Valve ring 107 is adapted to further reduce the liquid content of the resultant solid portion of the mass to the desired extent by the controlled pressure applied to the emerging mass as it passes through the circular opening 85 between its inside diameter and the outside diameter of the interior screen 87.

This liquid then passes through the longitudinal slits provided in its exterior circumference into the cylindrical tube portion 88 of the interior screen assembly 86 from whence it is drained through an outlet into a separate L-shaped pipe 88'' which communicates through a hole in the transverse partition wall 22 with the central compartment 14 of the shell and the aperture 23' in the floor 23 of the compartment. The semi-solid mass then drops through the open end of the rear compartment 15 of the shell onto the surface of a conveyor belt or the like (not shown) which delivers the resultant solids of the mass to the desired location for further processing or storage.

It should be recognized that although the cone and flight assembly mounted on the driven shaft are of a given configuration, any diameter shaft with a worm gear having a positive pitch may be used and fall within the scope of this invention.

Although but one embodiment of the invention has been shown and described, it should be apparent to those skilled in the art that various changes and modifications may be made therein without departing from the spirit of the invention or from the scope of the appended claims.

What is claimed is:

1. A press for extracting liquid from plastic material comprising:

a frame, a shaft at least a part of the periphery being in the form of a truncated cone rotatably mounted on said frame and having a worm section of positive pitch formed along at least a part of its outer periphery, the truncated cone of said shaft tapering from its apex near the upstream end of said shaft toward the downstream end thereof, a first cylinder mounted on said frame and surrounding the worm section of said shaft, said first cylinder being closed at its upstream end and open at its downstream end, the upstream end of said first cylinder being provided with an opening in its periphery for receiving plastic material, the perforated downstream portion of the periphery of said first cylinder is formed by spaced bars arranged longitudinally of said shaft around at least a part thereof at least a part of the downstream portion of the periphery of said first cylinder being perforated for passing liquid extruded from the plastic material, a ring mounted on said frame for axial movement to and from the downstream end of said first cylinder for controlling said opening of said first cylinder, pressure means for exerting predetermined pressure on said ring for biasing said ring toward the periphery of said partial opening, said pressure means comprising an inflatable means adaptable for receiving fluid under pressure of predetermined values, a second perforated cylinder mounted on said frame in axial alignment with the downstream end of said shaft and protruding through an aperture in said ring into abutting aligned contact with the periphery of the cone of said shaft whereby the plastic material extruded by said worm section of said shaft moves over the outer periphery of said second cylinder, the perforations of said second cylinder are formed by spaced bars arranged longitudinally of said shaft around at least a part thereof said second cylinder passing therethrough liquid pressed from said extruded material by said ring, and detachably mounted wear shoes mounted on the downstream side of the last flight of said worm section at the downstream end of said shaft.

2. The press set forth in claim 1 wherein:

said inflatable means comprises a flexible rubber ring having an inlet valve regulated by a pressure gauge.

3. The press set forth in claim 1 wherein:

said wear shoes are spacer mounted on the last flight of said worm section and flush with its outer surface.

* * * * *